US005432433A

United States Patent [19]

Ikeda

[11] Patent Number: 5,432,433

[45] Date of Patent: Jul. 11, 1995

[54] CURRENT SOURCE HAVING CURRENT MIRROR ARRANGEMENT WITH PLURALITY OF OUTPUT PORTIONS

[75] Inventor: Masaharu Ikeda, Yokohama, Japan

[73] Assignee: Matsushita Electric Industrial Co., Ltd., Osaka, Japan

[21] Appl. No.: 194,331

[22] Filed: Feb. 8, 1994

[30] Foreign Application Priority Data

Feb. 9, 1993 [JP] Japan ..... 5-045897

[51] Int. Cl.[6] ..... G05F 3/16

[52] U.S. Cl. ..... 323/315; 330/288

[58] Field of Search ..... 323/312, 315, 316, 317; 307/296.1, 296.6; 330/257, 288

[56] References Cited

U.S. PATENT DOCUMENTS

| | | | |
|---|---|---|---|
| 4,292,597 | 9/1981 | Niimura et al. | 330/257 |
| 4,612,496 | 9/1986 | Hines | 323/315 |
| 5,179,357 | 1/1993 | Perraud | 323/315 |
| 5,293,112 | 3/1994 | Takahashi | 323/315 |
| 5,323,124 | 6/1994 | Ikeda | 330/288 |

FOREIGN PATENT DOCUMENTS 60-191508 9/1985 Japan ..... H03F 3/343

*Primary Examiner*—Thomas M. Dougherty
*Assistant Examiner*—Matthew V. Nguyen
*Attorney, Agent, or Firm*—Spencer, Frank & Schneider

[57] ABSTRACT

A current source including a first transistor and a second transistor with their bases connected together, a resistor connected to the emitter of the first transistor, a third transistor with its base connected to the collector of the second transistor, and an amplifying unit. The amplifying unit has its input end connected to the collector of the third transistor and is further provided with a plurality of output portions with output resistors. The plurality of output portions of the amplifying unit are connected to the collectors of the first transistor, second transistor and third transistor, respectively. The base current of the third transistor is set to make the collector currents of the first transistor and second transistor substantially equal.

10 Claims, 4 Drawing Sheets

CURRENT SOURCE HAVING CURRENT MIRROR ARRANGEMENT WITH PLURALITY OF OUTPUT PORTIONS

BACKGROUND OF THE INVENTION

This invention relates to a current source which can be used in, for example, bipolar semiconductor integrated circuits.

Recently, semiconductor integrated circuits have been used in a variety of portable electronic equipments. Most of the portable electronic equipments have a battery for the power supply. The voltage between the terminals of the battery decreases as it repeatedly supplies its power. Even under this voltage-changing power supply, use of a current source which does not change its preset current has assured the performances of many portable electronic apparatus.

The current source of this kind, as disclosed in JP-A-60-191508, has a current mirror which is formed of first to third transistors of the same polarity and transistors of the opposite polarity, and resistors. In this case, the base current of the third transistor is set at a proper value in order to equalize the collector-emitter voltages Vce of the first and second transistors which are used as a reference for the current setting, and also to make their collector currents equal. Thus, the value of the current from this current source is not affected by a voltage change of the power supply, the temperature dependency of the current amplification factors hfe of the transistors and the dispersion between production lots.

The arrangement of such a current source will be described with reference to FIG. 7. Referring to FIG. 7, there are shown NPN transistors 1, 2, 3 and 8. The first transistor 1 has an emitter area equivalent to N second transistors 2 connected in parallel. There are also shown resistors 4 and 332, which are connected to the emitters of the first and third transistors 1 and 3, respectively. The collector current of the third transistor 3 flows to an input end of a current mirror 530 which is formed of PNP transistors 531 through 535. The collector current $Ic_{531}$ of the transistor 531 flows in the opposite direction to the collector of the first transistor 1 having a diode configuration as the first output current. Similarly, the collector current $Ic_{532}$ of the transistor 532 flows to the collector of the second transistor 2 as the second output current, and the collector current $Ic_{535}$ of the transistor 535 to the collector of the transistor 8 of diode configuration, or a load as the third output current. There are also shown a phase compensation capacitor 7 for negative feedback stabilization, a resistor 333 through which a current necessary for starting flows, and a power supply 9.

The operation of this conventional arrangement will be described with reference to FIGS. 7 and 8. The base-emitter voltage V1 of the second transistor 2 shown in FIG. 7 can be expressed by the collector current $Ic_1$ of the first transistor 1 and the collector current $Ic_2$ of the second transistor 2 as in the following equations (1) and (2):

$$V1 = Vt*In(Ic_1/(Is*N)) + R4*Ic_1 \quad (1)$$

$$V1 = Vt*In(Ic_2/(Is) \quad (2)$$

where

Vt=kT/q k: Boltzmann's constant q: charge of electron

T: absolute temperature

Is: reverse saturation current of NPN transistor

R4: resistance value of resistor 4

*: multiplication

FIG. 8 shows the curves of each term of Eqs. (1) and (2) and V1 of each equation with respect to the collector current $Ic_1$, $Ic_2$ in the abscissa. The points P and Q in FIG. 8 are the intersections of Eqs. (1) and (2), which satisfy $Ic_1 = Ic_2$ and have the common V1. By simultaneously solving the equations (1) and (2), it is possible to obtain the coordinates (collector current, base potential V1) of these points as follows:

the coordinates of point P are (0,0), and the coordinates of point Q are (Vt*In(N)/R4, Vt*In((Vt*In(N)/R4)/Is)).

Therefore, from FIG. 8, it will be found that $Ic_1 > Ic_2$ is satisfied when the magnitude of V1 is in the range from point P to point Q, and that $Ic_1 < Ic_2$ is satisfied when it is in the range larger than point Q.

If the base currents of the transistors 1 and 2 are now neglected, in the circuit arrangement of FIG. 7 the collector current $Ic_{531}$ of the transistor 531 as the output from the current mirror 530 becomes the collector current $Ic_1$ of the transistor 1 having a diode configuration, and the collector current $Ic_{532}$ of the transistor 532 as the output from the current mirror 530 flows in the node of point A. In addition, the reverse collector current $Ic_2$ of the transistor 2 flows in the node of point A. Thus, the magnitude of the total current flowing in the point A is $(Ic_1 - Ic_2)$.

When the magnitude of V1 is in the range from point P to point Q, the collector currents of transistors 1 and 2 satisfy the condition of $Ic_1 > Ic_2$. The current flowing in point A is positive, thus increasing the base current of the transistor 3 connected to point A. This results in an increase of the collector current $Ic_3$ which is the input current to the current mirror 530. At this time, the collector current $Ic_{531}$ of the transistor 531 as the output current from the current mirror 530 is increased, and thus the collector current $Ic_1$ of transistor 1 is also increased. Thus, as is clear from FIG. 8, the difference between $Ic_1$ and $Ic_2$ becomes small and the current flowing in point A decreases.

When the magnitude of V1 is larger than point Q, the collector currents of the transistors 1 and 2 satisfy the condition of $Ic_1 < Ic_2$, and the current flowing in point A is negative, thus decreasing the base current of the transistor 3 which is connected to the point A, or reducing the collector current $Ic_3$ as the input current to the current mirror 530. At this time, the collector current $Ic_{531}$ of the transistor 531 as the output current from the current mirror 530 is decreased, and thus the collector current $Ic_1$ of the transistor 1 is also reduced. Thus, as is evident from FIG. 8, the difference between $Ic_1$ and $Ic_2$ becomes small, and the current flowing in point A is decreased.

As the result of this operation, the circuit arrangement shown in FIG. 7 is stabilized at point Q. The output current at this operating point, for example, the collector current $Ic_{535}$ of the transistor 535 as one output current from the current mirror 530 can be expressed by the following equation (3):

$$Ic_{535} = Vt*In(N)/R4 \quad (3)$$

From FIG. 8, it will be found that there is another stabilization point P. The resistor 333 is provided so that even if the collector current of the transistor 3 is 0, the collector currents $Ic_1$, $Ic_2$ of the transistors 1, 2 are not 0, or the operation is not stabilized at point P.

In the above description, it is assumed that the current amplification factor hfe of each transistor is large and that the base current of each transistor can be neglected. However, the base current is temperature dependent and there is a large dispersion between production lots, thus degrading the precision of the apparatus output. Therefore, the collector current $Ic_3$ of the transistor 3 is set to the sum of the collector currents of the transistors 1 and 2. In other words, a current value corresponding to the base current of transistor 1, 2 which is removed from the collector current $Ic_{531}$ of the transistor 531 of the current mirror 530 is also removed from the collector current $Ic_{532}$ of another transistor 532 of the current mirror 530. This means that the base current of the transistor 3 can be increased to twice that of the transistor 1 or 2 by setting the input current to the current mirror 530 at twice the output current. As a result, the collector currents $Ic_1$ and $Ic_2$ of the transistors 1 and 2 become equal.

In addition, since the collector-emitter voltages of the transistors 1 and 2 are equal independently of the power supply voltage, the early effect (the current amplification factor hfe depends on the collector-emitter voltage Vce) in the change of power supply voltage can be canceled out, and thus the output current is not easily affected by the change of power supply voltage.

Therefore, even the conventional current source can be prevented from being affected by the change of power supply voltage, the temperature dependency of hfe of a transistor and the dispersion between production lots.

SUMMARY OF THE INVENTION

The above conventional current source, however, needs first to third transistors of the same polarity, and a current mirror which is formed of transistors of the opposite polarity. Thus, the semiconductor integrated circuit process by which transistors of only the same polarity can be produced can not realize this current source.

In addition, the third transistor needs a collector current twice as large in order to compensate for the base current. Thus, when the preset current is large, the dissipation current increases, so that the life of the battery in the portable electronic equipment is reduced.

Accordingly, it is an object of the invention to provide a current source which can be formed of transistors of either the NPN or PNP type, and which is not easily affected by the change of power supply voltage, the temperature dependency of hfe of a transistor and the dispersion between production lots.

It is another object of the invention to provide a current source which can be formed of transistors of the NPN and/or PNP types, is not easily affected by the change of power supply voltage, the temperature dependency of hfe of a transistor and dispersion between production lots, and has a small current dissipation.

In order to achieve these objects, according to one aspect of the invention, there is provided a current source including first and second transistors with their bases connected together, a resistor connected to the emitter of the first transistor, a third transistor with its base connected to the collector of the second transistor, and an amplifying unit which has its input end connected to the collector of the third transistor and a plurality of output portions having output resistors.

According to this current source, the amplifying unit can be formed of transistors of the same polarity as that of the first transistor through the third transistor, and the base current of the third transistor can be set so that the collector current of the first transistor is substantially equal to that of the second transistor. Therefore, this current source has the effect that it is not easily affected by the change of the power supply voltage, the temperature dependency of hfe of a transistor and the dispersion between production lots.

According to another aspect of the invention, there is provided a current source including first and second transistors with their bases connected together, a resistor connected to the emitter of the first transistor, a third transistor with its base connected to the collector of the second transistor, a fourth transistor with its emitter connected to the collector of the third transistor, and an amplifying unit which has its input end connected to the collector of the fourth transistor and a plurality of output portions having output resistors.

According to this current source, the amplifying unit can be formed of transistors of the same polarity as that of the first to fourth transistors, and the base current of the third transistor and the base current of the fourth transistor can be set so that the collector current of the first transistor is substantially equal to that of the second transistor. Therefore, this current source has the effect that it is not easily affected by the change of the power supply voltage, the temperature dependency of hfe of a transistor and the dispersion between production lots, and that it can be driven by less current.

According to still another aspect of the invention, there is provided a current source including first and second transistors with their bases connected together, a resistor connected to the emitter of the first transistor, a third transistor with its base connected to the collector of the second transistor, a fourth transistor with its emitter connected to the collector of the third transistor, and a current mirror which has its input end connected to the collector of the fourth transistor and a plurality of outputs.

According to this current source, the base current of the third transistor and the base current of the fourth transistor can be set so that the collector current of the first transistor is equal to that of the second transistor. Therefore, this current source has the effect that it is not easily affected by the change of the power supply voltage, the temperature dependency of hfe of a transistor and the dispersion between production lots, and that it can be driven by less current.

DESCRIPTION OF THE PREFERRED EMBODIMENTS

Figure 1:
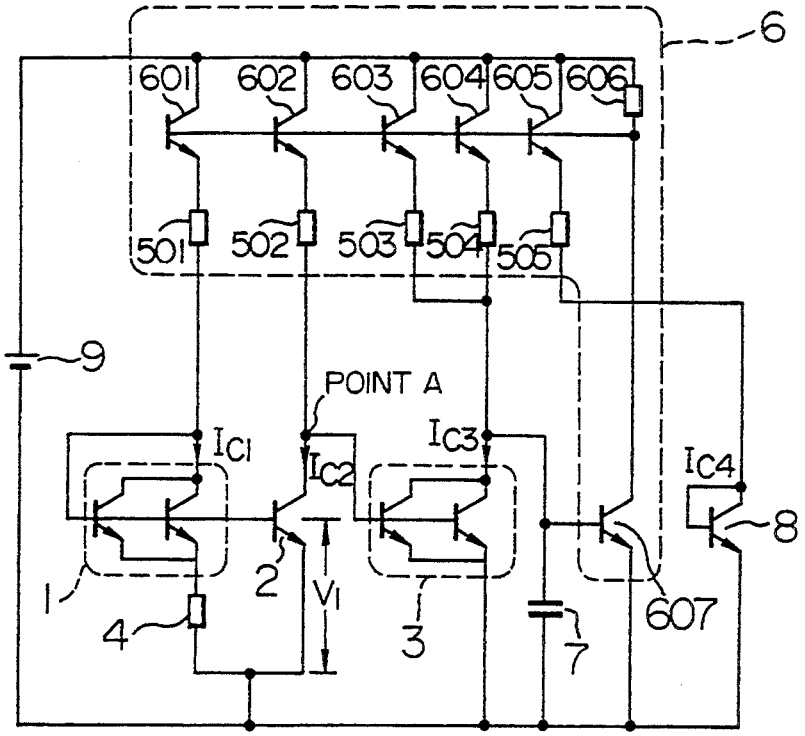
FIG. 1 is a circuit diagram of a current source of one embodiment of the invention.

Embodiments of a current source of the invention will be described with reference to the accompanying drawings. For convenience of explanation, like elements corresponding to those in the conventional example are identified by the same reference numerals.

(First embodiment)

FIG. 1 shows the arrangement of a current source of one embodiment of the invention. In this arrangement, PNP transistors are not used, and an emitter follower is used for each output of the amplifying unit.

Referring to FIG. 1, there are shown the NPN transistors 1, 2, 3 and 8. The first transistor 1 has an emitter area equivalent to N second transistors 2 connected in parallel (N=2 in FIG. 1). The third transistor 3 has an emitter area equivalent to two second transistors connected in parallel. There are also shown the resistor 4 which is connected to the emitter of the first transistor 1, and an amplifying unit 6 which has a plurality of output portions with output resistors. This amplifying unit is formed of an emitter-grounded transistor 607, a load resistor 606, transistors 601 through 605 of emitter follower configuration acting as a buffer, and output resistors 501 through 505. The output voltages within the amplifying unit 6 are converted into currents and supplied through the resistors 501 through 505 of the same size as the collectors of the transistors 1, 2, 3 and load 8. There are also shown the phase compensation capacitor 7 for negative feedback stabilization, and the power supply 9.

The operation of this embodiment will be described. In FIG. 1, the transistors 1, 2 and 3 and the resistor 4 are connected in the same way as in the conventional arrangement of FIG. 7 except that the transistor 3 has two transistors connected in parallel. Therefore, the base-emitter voltage V1 of the transistor 2 can be expressed by collector currents $Ic_1$, $Ic_2$ as in the previously given equations (1) and (2). The relation of the collector currents $Ic_1$, $Ic_2$ and V1 is shown in FIG. 8. The intersections are the same as in the conventional example. In addition, as in the circuit of FIG. 7, the condition of $Ic_1 > Ic_2$ is satisfied when the magnitude of V1 is in the range from point P to point Q, and a condition of $Ic_1 < Ic_2$ is satisfied when it is larger than point Q.

In the circuit arrangement, the collector potential of the transistor 1 is the value of Vbe since the transistor 2 is directly grounded and not through any resistor. The collector potential of the transistor 2 is the value of Vbe since the transistor 3 is directly grounded and not through any resistor. In addition, the collector potential of the transistor 3 is the value of Vbe since the transistor 607 is directly grounded and not through any resistor. Moreover, the collector potential of the load, or transistor 8 is the value of Vbe because of its diode configuration. Therefore, the voltages across the resistors 501 through 505 are all equal, and since the values of the resistors are equal, the currents flowing therethrough are equal.

If, now, the base currents of the transistors 1, 2, 3 and 8 are neglected, the current flowing through the resistor 501 equals the collector current $Ic_1$ of the transistor 1 having a diode configuration, and the current in the resistor 502 flows in the node A shown in FIG. 1. Since the reverse collector current $Ic_2$ of the transistor 2 also flows in the node A, the sum of the currents flowing in point A is $(Ic_1 - Ic_2)$.

When the value of V1 is in the range from point P to point Q, the collector currents of the transistors 1 and 2 satisfy the condition of $Ic_1 > Ic_2$, and the current flowing in point A is positive. Thus, the base current of the transistor 3 connected to the point A increases, causing the collector current $Ic_3$ to increase. At this time, the base current of the transistor 607 of the amplifying unit 6 decreases, causing the base potential of the transistors 601 through 605 to increase with the result that the voltages across the resistors 501 through 505 are increased. Therefore, the collector current $Ic_1$ of the transistor 1 also increases. From FIG. 8, it will be understood that the difference between $Ic_1$ and $Ic_2$ decreases, so that the current flowing in point A decreases.

When the value of V1 is larger than point Q, the collector currents of the transistors 1 and 2 satisfy the condition of $Ic_1 < Ic_2$, and the current flowing in point A is negative. Thus, the base current of the transistor 3 connected to the point A decreases, causing the collector current $Ic_3$ to decrease. At this time, the base current of the transistor 607 of the amplifying unit 6 increases, causing the base potential of the transistors 601 through 605 to decrease so that the voltages across the resistors 501 through 505 are reduced. As a result, the collector current $Ic_1$ of the transistor 1 also decreases. From FIG. 8, it will be found that the difference between $Ic_1$ and $Ic_2$ becomes small so that the current flowing in point A is reduced.

As a result of these operations, the circuit arrangement shown in FIG. 1 is stabilized at point Q in FIG. 8. The output current at this operating point, for example, the collector current $Ic_4$ of the transistor 8 can be expressed by the following equation (4).

$$Ic_4 = Vt * In(N)/R4 \quad (4)$$

Another stabilization point, or point P does not exist because the collector currents $Ic_1$, $Ic_2$ of the transistors 1, 2 are not zero in the circuit arrangement. Thus, such a starting circuit as shown in the conventional example is not necessary.

In the above description, it is assumed that the current amplification factor hfe of each transistor is large and that each base current can be neglected. However, the base current is set so that the collector current $Ic_3$ of the transistor 3 is equal to the sum of the collector currents of the transistors 1, 2 because the precision of the current source output is greatly decreased by the temperature dependency and large dispersion between production lots. In other words, the same current as the base current of the transistors 1 and 2 is subtracted not only from the current flowing through the resistor 501 but also from the current flowing through the resistor 502. Thus, by supplying a two-fold current to the collector of the transistor 3 through the resistors 503 and 504, it is possible to increase the base current of the transistor 3 to a value twice as large as the base current of the transistor 1 or 2. As a result, the collector currents $Ic_1$ and $Ic_2$ of the transistors 1 and 2 are equal to each other.

Since the collector-emitter voltages of the transistors 1, 2 are equal in the circuit arrangement irrespective of the power supply voltage, the early effect caused when the power supply voltage is changed can be canceled out, and thus the output current is not easily affected by the change of the power supply voltage.

Figure 2:
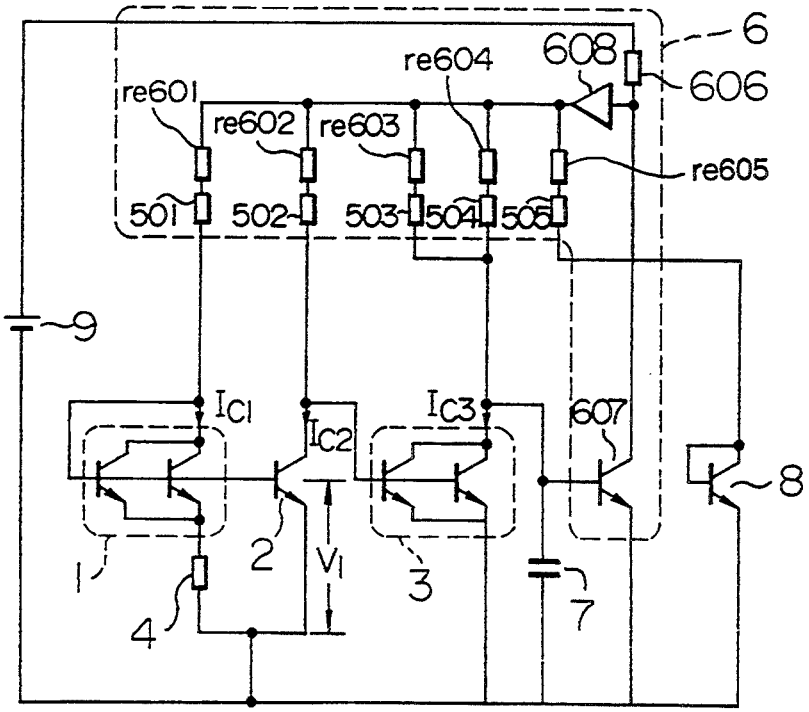
FIG. 2 is a circuit diagram of an equivalent circuit of the output circuit of the amplifying unit of the current source shown in FIG. 1.

Although the potential differences between the output voltages within the amplifying unit 6 and the collector voltages of transistors 1, 2, 3, 8 cause currents to flow in the resistors 501 through 505, respectively, as described with reference to FIG. 1 in which this embodiment is shown, the dynamic resistances of the transistors 601 through 605 are necessary to add to those resistors if we consider the change of the base-emitter voltage to the emitter current of a transistor. FIG. 2 shows an equivalent circuit which includes these dynamic resistances. The transistors 601 through 605 of the amplifying unit 6 can be expressed by a buffer which is shifted in level by the Vbe value, and the dynamic resistances re601 through re605. Thus, the currents flowing to the transistors 1, 2, 3, 8 through the resistances as the elements must be set by adding the dynamic resistances re601 through re605 to the values of the resistors 501 through 505. The dynamic resistances re601 through re605 are equal since the collector currents are the same.

If the base-emitter voltages Vbe of the transistors 1, 2, 3, 8 are just the same, the voltages across the resistors including the dynamic resistances are equal, and thus the dynamic resistances function as output resistances even if the resistors 501 through 505 are zero Ω. In other words, if the emitter areas and collector currents of the transistor 1, 2, 3, 8 and collector current can be properly set, and if the output resistance values may be small, the resistors 501 through 505 as elements are not necessary, and the dynamic resistances of the transistors 601 through 605 act as output resistances, thus realizing the operation of the above embodiment. Therefore, the elements called the output resistances in the specification and the accompanying claims include not only the resistances as resistor elements but also the resistances as functional elements.

(Second embodiment)

Figure 3:
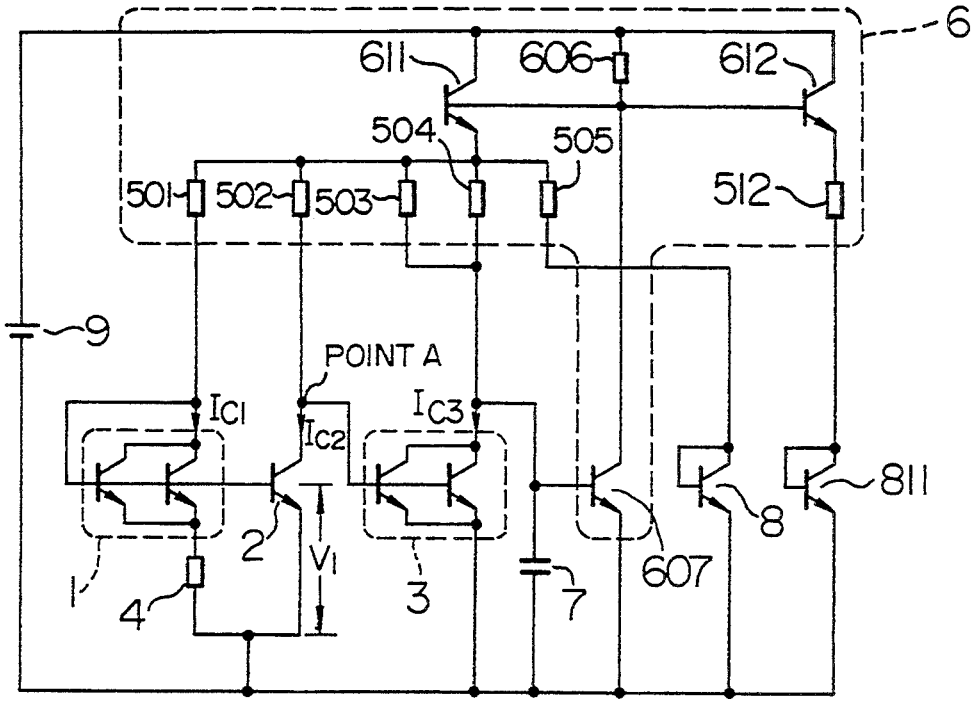
FIG. 3 is a circuit diagram of the arrangement of a current source of another embodiment of the invention.

FIG. 3 shows the arrangement of a current source of the second embodiment of this invention. In this embodiment, particularly no PNP transistors are used, and the outputs of the amplifying unit includes a common emitter follower and a separate emitter follower. The embodiment shown in FIG. 3 is different from that shown in FIG. 1 in that the emitter follower transistors 601 through 605 of the amplifying unit 6 are combined into a single transistor 611 and that an emitter follower transistor 612, an output resistor 512 and a load transistor 811 are additionally used in order to provide a new current output terminal. The value of the resistor 512 cannot be made just equal to the value of the resistors 501 through 505 since the transistors 611 and 612 have different collector currents and hence different dynamic resistances. However, if the voltage drop across the resistors 501 through 505 can be set to be large, the dynamic resistances and the base-emitter voltage of transistor 811 can be neglected, and thus it can be made equal to the value of resistors 501 through 505.

The operation of this embodiment is the same as that of the embodiment shown in FIG. 1 since only the output configuration of the amplifying unit 6 is different from the embodiment of FIG. 1. In other words, since the collector currents of the transistors 601 through 605 shown in FIG. 1 are equal, each emitter potential is also equal. Therefore, even if each of the emitters of the transistors 601 through 605 is short-circuited, no current is caused to flow, and hence the operation of this embodiment is not different from that of the first embodiment.

When the first embodiment is compared with the second embodiment the operation of which is not different from that of the first embodiment, it will be found that the emitter area of the emitter follower transistors (601 through 605) is six times as large as that of the transistor 611 except for the additional new output terminal. This difference does not affect the current flowing in the collectors of the transistors 1, 2, 3 which are important when the currents of the current source are set. However, it affects the setting of the additionally provided output current. In other words, since the dynamic resistances and base-emitter voltages of the transistors 611 and 612 are different due to their collector currents and since the base-emitter voltage Vbe of the transistor 811 is different from those, the current in the transistor 8 becomes different from that in the additionally provided transistor 811 for output current. This difference can be prevented by setting the voltage drop across the resistors 501 through 505 to negligibly minimize the difference in the dynamic resistances and Vbe of transistor 811 or by setting the value of the resistor 512 allowing for the difference in Vbe and so on.

The first and second embodiments of the invention have just been described above. According to the above first and second embodiments, the following effects can be achieved.

(1) The transistors 601 through 605 and 607 which constitute the amplifying unit may have the same polarity as the transistors 1 through 3.

(2) The base current of the transistor 3 can be set so that the collector current of the transistor 1 is substantially equal to that of the transistor 2. Thus, it is possible to almost remove the effect of the temperature dependency of hfe of a transistor and dispersion between production lots.

(3) Since the collector-emitter voltages of the transistors 1 and 2 can be made equal, no early effect appears, and thus there is almost no effect of the change of power supply voltage.

(Third embodiment)

Figure 4:
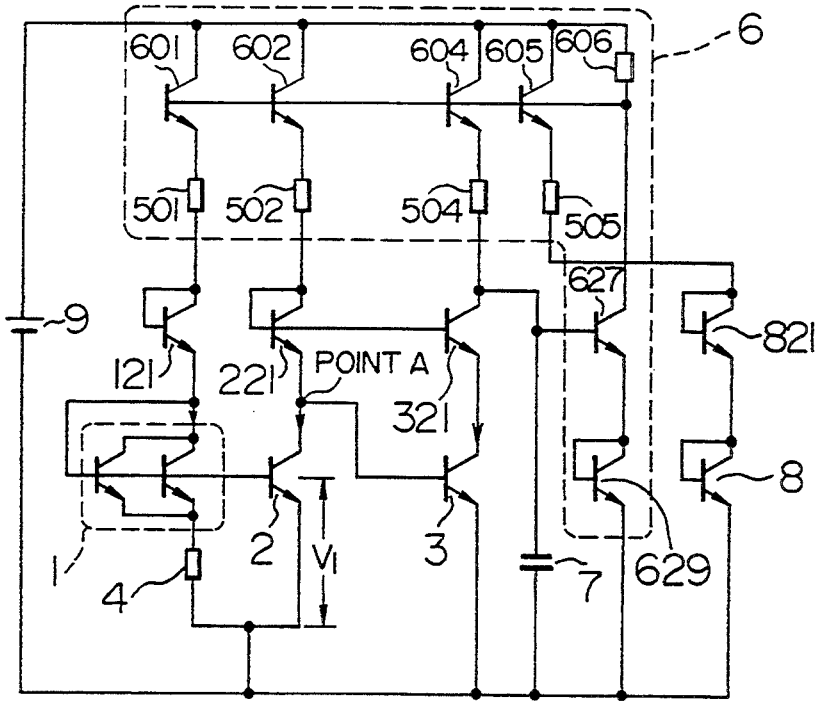
FIG. 4 is a circuit diagram of the arrangement of a current source of still another embodiment of the invention.

FIG. 4 shows the arrangement of the third embodiment of this invention. In this arrangement, particularly no PNP transistors are used, and an emitter follower is provided at each output of the amplifying unit. In addition, the current in the third transistor for driving purpose is reduced by half. In FIG. 4, there are shown NPN transistors 1, 2, 3, 121, 221, 321, 8, 821. The first transistor 1 has an emitter area equivalent to N parallel second transistors 2 (N=2 in FIG. 4). The transistors 121, 221 are connected in a diode configuration to be level-shifted by Vbe. The fourth transistor 321 and third transistor 3 are cascaded so that the collector current of the third transistor 3 directly flows to the emitter of the fourth transistor. The resistor 4 is connected to the emitter of the first transistor 1. Shown at 6 is the amplifying unit which has a plurality of output portions with output resistors. This unit is formed of a transistor 627 with its emitter grounded through a level-shifting transistor 629 having a diode configuration, a load resistor 606, emitter-follower transistors 601, 602, and 604 and 605 acting as a 605 buffer and output resistors 501, 502, 504 and 505. The output voltages within the amplifying unit 6 are converted into currents and supplied through the resistors 501, 502, 504 and 505 of the same size to the collectors of the transistors 121, 221, 321 and load 821. There are also shown the phase compensation capacitor 7 for negative stabilization and the power supply 9.

As compared with the first embodiment, this third embodiment has a single transistor 3 unlike two parallel transistors, and the currents flowing through output resistors from the outputs of the amplifying unit 6 are reduced by half. In addition, the Vbe level shift transistors 121, 221 are respectively connected to the collectors of the transistors 1, 2, and the fourth transistor 321 is cascaded to the collector of the transistor 3.

The operation of the third embodiment of the invention is the same as that of the first embodiment of the invention in the mechanism for determining the currents. This embodiment is different from the previous embodiments in the method for making the collector currents of the transistors 1 and 2 equal. As illustrated in FIG. 4, the collector current of the transistor 3 equals the emitter current of the fourth transistor 321 which is cascaded to the third transistor. The current amplification factor hfe of the generally available transistor is normally about 100, and the collector current of the fourth transistor 321 is substantially equal to the emitter current. Therefore, the collector current of the third transistor 3 is substantially the same as that of the fourth transistor 321, and the base current of each transistor is also equal.

The base currents of the transistors 3, 321 in the circuit arrangement are subtracted from the current flowing in the resistor 502. In other words, in order that the same current value as the base current of the transistors 1, 2 which is subtracted from the current flowing in the resistor 501 can also be removed from the current flowing in the resistor 502, the current flowing through the resistor 504 to the transistor 321 is set to be the same value as the current flowing to the transistors 1, 2, and the sum of the base currents in the transistors 321 and 3 is made equal to the sum of the base currents of the transistors 1 and 2. As a result, the collector currents $Ic_1$ and $Ic_2$ of the transistors 1 and 2 become equal to each other.

Also, since in this circuit arrangement the collector potential of the transistor 121 is a value of Vbe*2 since the transistor 2 has its emitter directly grounded and not through any resistor. Similarly, the collector potential of the transistor 221 is a value of Vbe*2 since the transistor 3 has its emitter directly grounded and not through any resistor. In addition, the collector potential of the transistor 321 is a value of Vbe*2 since the transistor 627 has its emitter directly grounded through the level shift transistor 629. Moreover, the collector potential of the load transistor 821 having a diode configuration is a value of Vbe*2 since the transistor 8 a diode configuration is connected in series with the load transistor. Therefore, the voltages across the resistors 501, 502, 504 and 505 are all equal, and the currents flowing therein have the same value.

In addition, according to this circuit arrangement, since the collector-emitter voltages of the transistors 1 and 2 are equal irrespective of the power supply voltage, the early effect due to the change of the power supply voltage can be canceled out, and the output currents are not easily affected by the change of the power supply voltage.

Therefore, according to the third embodiment, the following effects can be achieved.

(1) The transistors 601, 602, 604, 605 and 629 constituting the amplifying unit may be of the same polarity as the transistors 1 through 3.

(2) The base current of the transistor 3 can be set so that the collector current of the transistor 1 is made equal to that of the transistor 2, and there is almost no effect of the temperature dependency of the current amplification factor hfe of a transistor and the dispersion between production lots.

(3) Since the collector-emitter voltages of the transistors 1 and 2 can be made equal to each other, no early effect appears and thus there is almost no effect of the change of power supply voltage.

(4) The circuit dissipation current for use in making the collector currents of the transistors 1 and 2 equal can be reduced by half that in the first embodiment.

While in the third embodiment emitter follower transistors 601, 602, 604 and 605 are used at the outputs of the amplifying unit 6, these transistors may be replaced by the single transistor 611 as in the second embodiment, in which case the same effects can be achieved.

(Fourth embodiment)

Figure 5:
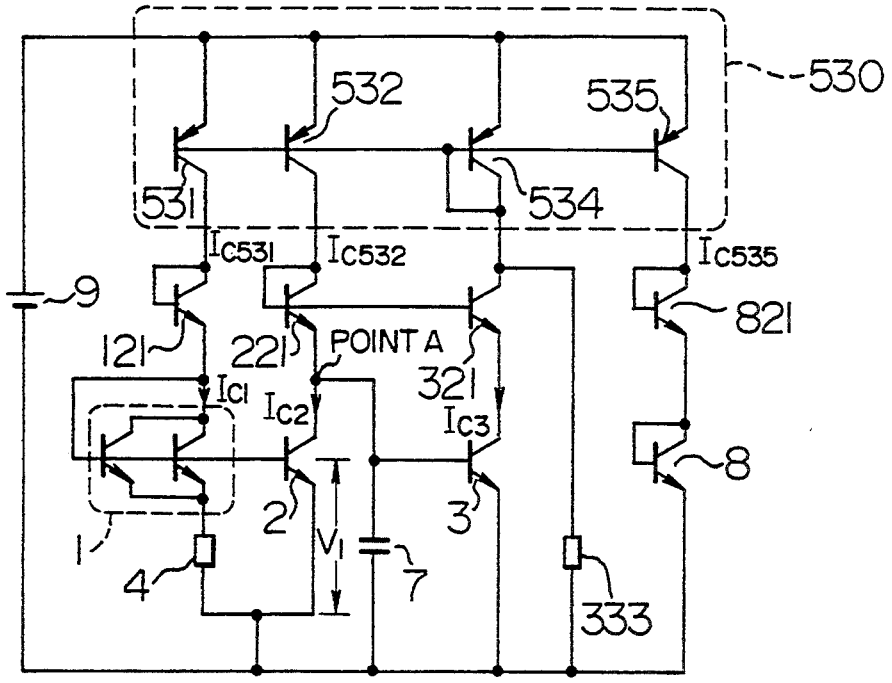
FIG. 5 is a circuit diagram of the arrangement of a current source of a further embodiment of the invention.

FIG. 5 shows the arrangement of the fourth embodiment of the invention. In this embodiment, PNP transistors and NPN transistors are used as in the conventional example, and particularly the current of the third transistor for driving is reduced to half. In FIG. 5, there are shown NPN transistors 1, 2, 3, 121, 221, 321, 8, 821. The first transistor 1 has an emitter area equivalent to N parallel second transistors (N=2, in FIG. 5), and the transistors 121, 221 are of diode configuration and used for level shifting. The fourth transistor 321 and the third transistor 3 are cascaded so that the collector current of the third transistor 3 directly flows to the emitter of the fourth transistor. There is shown the resistor 4 which is connected to the emitter of the first transistor 1. The collector current of the fourth transistor 321 flows to the input end of the current mirror 530 which is formed of PNP transistors 531, 532, 534, 535. The first output current, or reverse collector current $Ic_{531}$ of the transistor 531 flows to the collector of the first transistor 1 having a diode configuration, the second output current, or collector current $Ic_{532}$ of the transistor 532 to the collector of the transistor 2, and the third output current, or collector current $Ic_{535}$ of the transistor 535 flows to the collector of the load transistor 821 having a diode configuration. There are also shown the phase compensation capacitor 7 for negative feedback stabilization, the resistor 333 through which a current necessary for starting flows, and the power supply 9.

Figure 7:
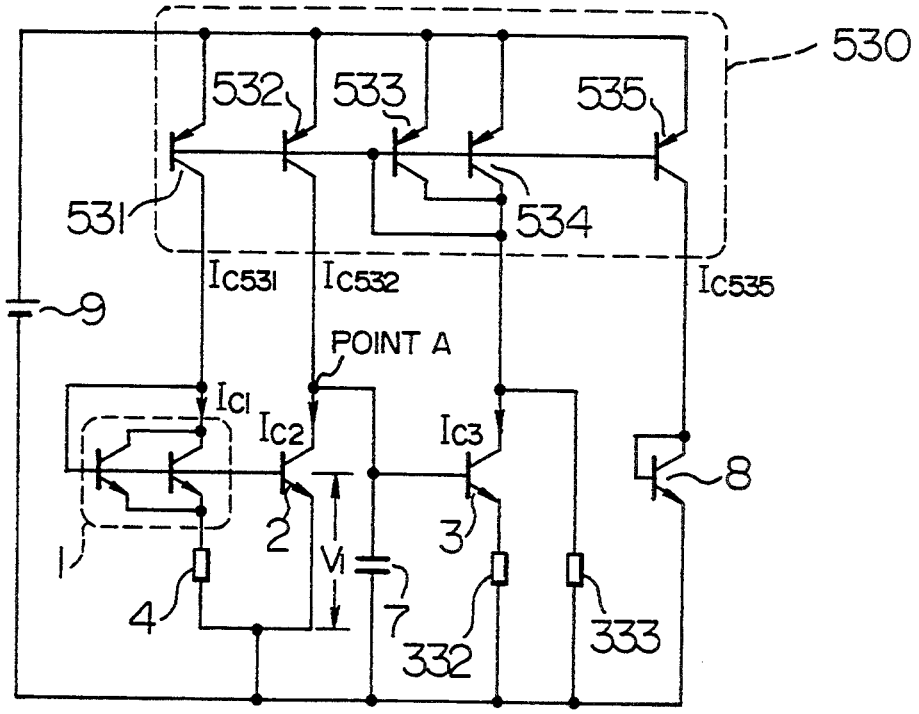
FIG. 7 PRIOR ART
FIG. 7 is a circuit diagram of the arrangement of a conventional current source.
Figure 8:
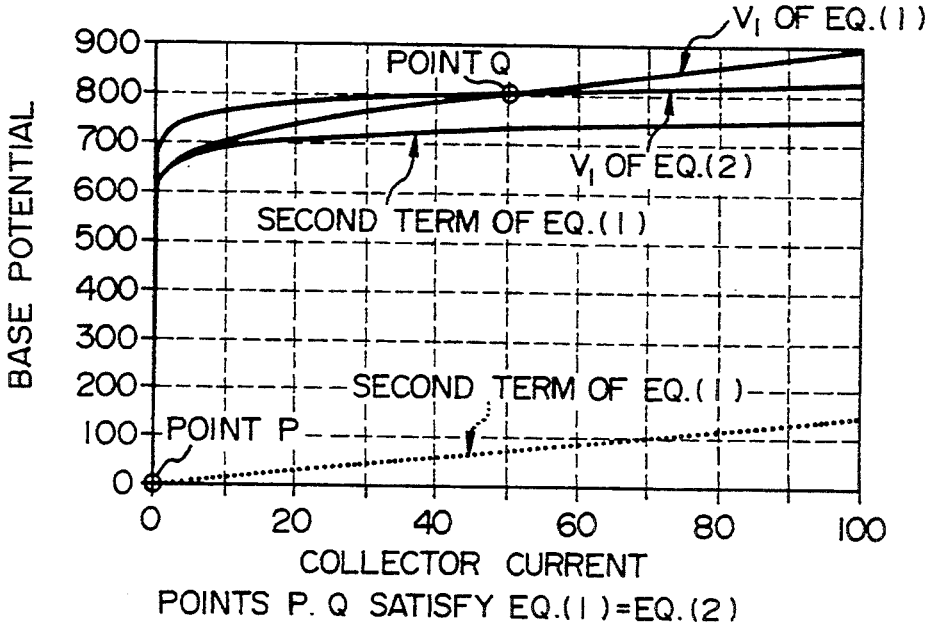
FIG. 8 PRIOR ART
FIG. 8 is a graph of the collector current and V1 of the first and second transistors in the conventional current source of FIG. 7.

As compared with the conventional example shown in FIG. 7, the fourth embodiment of FIG. 5 has the following construction. The two parallel transistors 533 and 534 of the current mirror 530 in the conventional example are replaced by the single transistor 534, and the Vbe level shift transistors 121 and 221 are additionally connected to the collectors of the first and second transistors 1 and 2. Moreover, the transistor 321 is cascaded to the collector of the third transistor 3. The resistor 333 for starting is connected to the collector of the transistor 321 not to the collector of the transistor 3. In addition, when this embodiment shown in FIG. 5 is compared with the third embodiment shown in FIG. 4, it will be found that fundamentally the amplifying unit 6 is replaced by the current mirror 530 though the phase compensation capacitor and starting resistor may or may not be used in those embodiments.

The mechanism for determining the currents in the operation of this fourth embodiment is the same as in the first embodiment or in the prior art. The differences lies in the method for making the collector currents of the transistors 1 and 2 equal. In FIG. 5, the collector current of the third transistor 3 is just the emitter current of the fourth transistor 321 which is cascaded to the third transistor. The current amplification factor hfe of the generally available transistor is normally about 100, and the collector current of the transistor 321 is substantially equal to the emitter current. Therefore, the collector current of the transistor 3 becomes substantially equal to that of the transistor 321, and the base currents of those transistors are the same.

In this circuit arrangement, the base currents of the transistors 3, 321 are subtracted from the collector current $Ic_{532}$ of the transistor 532 of the current mirror 530. In other words, in order that the same current value as the base current of the transistors 1 and 2 which is subtracted from the collector current $Ic_{531}$ of the transistor 531 of the current mirror 530 is subtracted from the collector current $Ic_{532}$ of another transistor 532 of the current mirror 530, the input current to the current mirror is set to the same value as the output current, and the sum of the base current of the transistor 321 and the base current of the transistor 3 is made equal to the sum of the base current of the transistor 1 and the base current of the transistor 2. As a result, the collector currents $Ic_1$ and $Ic_2$ of the transistors 1 and 2 become equal.

Also in this circuit arrangement, the collector potential of the transistor 121 is a value of Vbe*2 since the transistor 2 has its emitter directly grounded and not through any resistor, and the collector potential of the transistor 221 is a value of Vbe*2 since the transistor 3 has its emitter directly grounded and not through any resistor. The collector potential of the load transistor 821 having a diode configuration is also a value of Vbe*2 since the transistor 8 having a diode configuration is connected in series to the load transistor. Therefore, the collector-emitter voltages Vce of the transistors 531, 532, 535 are all equal, and the collector currents of those transistors are the same even if the early effect appears.

Moreover, in this circuit arrangement, since the collector-emitter voltage of the group of the transistors 1 and 2 which are required to have the same polarity is equal to that of the group of the transistors 531, 532 and 535 irrespective of the power supply voltage, the early effect due to the change of the power supply voltage can be canceled out, and the output currents are not easily affected by change of the power supply voltage.

Thus, according to the fourth embodiment, the following effects can be achieved.

(1) The base current of the transistor 3 can be set so that the collector current of the transistor 1 is made substantially equal to that of the transistor 2, and thus there is almost no effect of the temperature dependency of the current amplification factor hfe of a transistor and the dispersion between production lots.

(2) Since the collector-emitter voltages of the transistors 1 and 2 can be made equal, the early effect does not appear, and thus there is almost no effect of the change of the power supply voltage.

(3) Since the collector-emitter voltages of the transistors 531, 532, 535 which constitute the current mirror 530 can be made equal, no early effect appears, and thus there is almost no effect of the change of the power supply voltage.

(4) The circuit dissipation current for use in making the collector current of the transistor 1 equal to that of the transistor 2 can be reduced to half that in the prior art.

This invention is not limited to the first through fourth embodiments of the invention. For example, the first through fourth embodiments can be modified as in FIG. 6.

Figure 6:
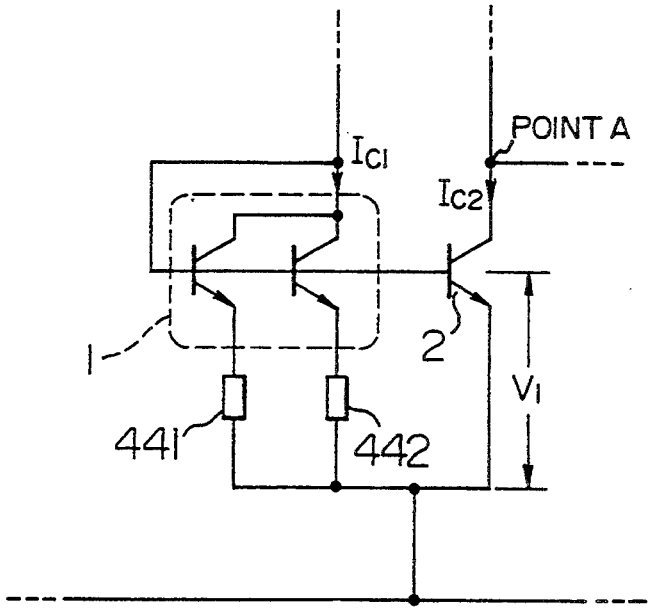
FIG. 6 is a circuit diagram of a modification of each current source shown in FIGS. 1, 3, 4 and 5.

FIG. 6 shows an example of modifying the first through fourth embodiments in the connection of transistor 1 and resistor 4 without changing the current setting function. The transistor 1 in these embodiments has an emitter area equivalent to N parallel second transistors 2 (N=2, in FIG. 1). In order to realize this structure, two methods can be employed: a plurality of transistors are connected in parallel; and a single transistor having a predetermined large emitter area is connected. The former structure can take two possible combinations: as shown in the embodiments of FIG. 1 through 5, the common emitter of a parallel circuit of transistors with common emitter, common collector and common base is connected to the resistor 4; and as shown in FIG. 6, the emitters of the parallel-connected transistors with only common collector and common base are respectively connected to resistors each of which has the same function as the resistor 4.

In FIG. 6, the collector current of the transistor 1 is divided into the collector currents of the transistors constituting the parallel circuit, or divided by N. If the current amplification factor hfe of the transistors constituting the transistor 1 is assumed to be very large, the collector current can be considered to be equal to the emitter current. Thus, the divided-by-N currents flow through resistors 441 and 442, respectively. If the value of the resistors 441, 442 is set to be N time as large as the resistor 4 in the first through fourth embodiments, the voltage drop across each of the resistors 441 and 442 is the same as that across the resistor 4. The circuit equation of this part will be given by the following equation (5).

$$V1 = Vt*In((Ic_1/N)/Is)+(R4*N)*(Ic_1/N) \quad (5)$$

This equation can be rearranged into the equation (1).

The sum of the values of the resistors 441 and 442 shown in FIG. 6 becomes $N_2$ times the value of the resistor 4 in the first through fourth embodiments. Thus, these resistors will make the integrated circuit chip area large. This structure, however, has the effect that when the reverse saturation current Is of the parallel transistors constituting the transistor 1 has a certain value of dispersion, the respective resistors 441 and 442 adjust the voltages thereacross, thus preventing the preset current value from being affected by the dispersion.

In addition, the amplifying unit 6 and the phase compensation capacitor 7 in the first through third embodiments can be modified in their structures as follows.

(1) The voltage gain in the amplifying unit 6, which is the mutual conductance of the transistor 607 multiplied by the resistance value of the load resistor 606, can be further increased by replacing the load resistor 606 by a current source of a large signal source resistance. If FETs can be produced by a semiconductor process, the current mirror and current source can be formed by these FETs. This can further reduce the effect of the power supply voltage change and the hfe change of transistor.

(2) The base potential of the transistor 607 at the input terminal of the amplifying unit 6 should be made equal to the collector potential of the transistors 1, 2. If this condition is satisfied, another different construction may be employed. In other words, it is possible to use a differential amplifier or operational amplifier which is constructed to satisfy the condition of the input potential.

(3) The capacitor 7 may be substantially formed of a plurality of capacitors the number of which is arbitrary, connected at any position and realized in any way as long as it can compensate for the gain and phase of a one-cycle transfer characteristic for stabilizing the feedback. For example, the capacitor 7 may be replaced by a capacitor of less capacitance connected between the base and collector of the transistor 607 so that the mirror effect can be expected.

(4) The output portions of the amplifying unit 6, which are formed of NPN transistors of an emitter follower configuration, may be other buffer means. For example, they may be FETs of a source follower configuration. In this case, the dynamic resistance which is produced by the change of the gate-source voltage relative to the change of the source current is included in the output resistance.

(5) The phase of the change of the output voltage in the amplifying unit 6 is negative with respect to the change of the input voltage to the amplifying unit 6, but it may be positive. In this case, however, it is necessary to exchange the configurations of the transistors 1 and 2, or change the transistors 1 and 2 to normal configuration and diode configuration, respectively, and to switch the base of the transistor 3 from the collector of the transistor 2 to the collector of the transistor 1 so that the entire current source is of the negative feedback configuration.

Also in the first through fourth embodiments, the emitters of the transistors 2, 3, transistor 607 and 629, and transistor 8 are connected to the ground terminal of the DC power supply, but may be all connected to one node which is kept at a common potential or grounded through resistors set so as to be maintained at the same potential. In the latter method in which the emitters are grounded through resistors, respectively, it is possible to decrease the mutual conductance which corresponds to the rate of change of the collector current relative to the change of the base potential, and to achieve the effect for stabilizing the negative feedback when the voltage gain of the amplifying unit 6 is large.

In the first through third embodiments, while all the transistors used are of NPN type, all of them may be PNP type.

In the fourth embodiment, while the starting resistor 333 is connected to the collector of the transistor 321, it may be connected to the emitter of the transistor 321. In this case, since the current in the resistor 333 is added to the collector current of the transistor 321, a current larger than the base current of the transistor 1, 2 to be compensated flows in the base of the transistor 321. On the other hand, however, when the voltage of the power supply 9 is changed to a great extent, the voltage across the resistor is suppressed by the emitter potential of the transistor 321, so that the preset current can be prevented from being greatly changed. Therefore, the resistance value is determined in view of the trade-off of the defect of the compensated base current deviation and the effect of insensitivity to the change of power supply voltage.

In the first through fourth embodiments, while it is described that the source current outputs are at the transistors 8, 811, 821, the outputs may be located at the junction of the emitter of the transistor 2 and the resistor 4 at which the sum of the collector currents of the transistors 1 and 2 flows, which junction is connected to the ground terminal of the power supply 9, or at another junction at which the emitter current of the transistor 3 and the sum of the collector currents are added. Furthermore, in the first through third embodiments, the collector currents of the transistors 601 through 605, 611, 612 may be the source outputs. In the current source of each embodiment of the invention, the currents flowing from the power supply to the ground terminal except the drive currents for the amplifying unit or current mirror are not easily affected by the power supply voltage change and the change of hfe of a transistor, or have the effect of the object of the invention. Thus, the output current may be any one of these currents.

What is claimed is:

1. A current source comprising:

a first transistor and a second transistor, the bases of said first and second transistors being connected together;

a resistor connected to the emitter of said first transistor;

a third transistor having its base connected to the collector of said second transistor; and an amplifying unit having its input terminal connected to the collector of said third transistor, said amplifying unit having a plurality of output portions, each of said output portions including an output resistor;

said plurality of output portions being connected to the collectors of said first transistor, said second transistor and said third transistor, respectively, the base current of said third transistor being set to make the collector currents of said first transistor and said second transistor substantially equal.

2. A current source according to claim 1, wherein said amplifying unit includes an emitter-grounded transistor and emitter followers.

3. A current source comprising:

a first transistor and a second transistor, the bases of said first and second transistors being connected together;

a resistor connected to the emitter of said first transistor;

a third transistor having its base connected to the collector of said second transistor;

a fourth transistor having its emitter connected to the collector of said third transistor; and an amplifying unit having its input terminal connected to the collector of said fourth transistor and a plurality of output portions, each of said output portions including an output resistor;

said plurality of output portions being connected to the collectors of said first transistor, said second transistor and said third transistor, respectively, the base currents of said third transistor and said fourth transistor being set to make the collector currents of said first transistor and said second transistor substantially equal.

4. A current source according to claim 3, wherein said amplifying unit includes an emitter-grounded transistor and emitter followers.

5. A current source comprising:

a first transistor and a second transistor, the bases of said first and second transistors being connected together;

a resistor connected to the emitter of said first transistor;

a third transistor having its base connected to the collector of said second transistor;

a fourth transistor having its emitter connected to the collector of said third transistor; and a current mirror having its input terminal connected to the collector of said fourth transistor, said current mirror having a plurality of outputs;

said plurality of outputs of said current mirror being respectively connected to the collectors of said first transistor, said second transistor and a load transistor, the base currents of said third transistor and said fourth transistor being set to make the collector currents of said first transistor and said second transistor substantially equal.

6. A current source comprising:

a plurality of first transistors, said plurality of first transistors having their collectors connected together and their bases connected together;

a second transistor having its base connected to the bases of said plurality of first transistors;

a plurality of resistors connected to the emitters of said plurality of first transistors, respectively;

a third transistor having its base connected to the collector of said second transistor; and an amplifying unit having its input end connected to the collector of said third transistor, said amplifying unit having a plurality of output portions, each of said plurality of output portions including an output resistor;

said plurality of output portions being respectively connected to the collectors of one of said plurality of first transistors, said second transistor and said third transistor, the base current of said third transistor being set to make the sum of the collector currents of said plurality of first transistors and the collector current of said second transistor substantially equal.

7. A current source according to claim 6, wherein said amplifying unit includes an emitter-grounded transistor and emitter followers.

8. A current source comprising:

a plurality of first transistors, said plurality of first transistors having their collectors connected together and their bases connected together;

a second transistor having its base connected to the bases of said plurality of first transistors;

a plurality of resistors connected to the emitters of said plurality of first transistors, respectively;

a third transistor having its base connected to the collector of said second transistor;

a fourth transistor having its emitter connected to the collector of said third transistor; and an amplifying unit having its input end connected to the collector of said fourth transistor, said amplifying unit having a plurality of output portions, each of said output portions including an output resistor;

said plurality of output portions being respectively connected to the collectors of one of said plurality of first transistors, said second transistor and said third transistor, the base currents of said third transistor and said fourth transistor being set to make the sum of the collector currents of said plurality of first transistors and the collector current of said second transistor substantially equal.

9. A current source according to claim 8, wherein said amplifying means includes an emitter-grounded transistor and emitter followers.

10. A current source comprising:

a plurality of first transistors, said plurality of first transistors having their collectors connected together and their bases connected together;

a second transistor having its base connected to the bases of said plurality of first transistors;

a plurality of resistors connected to the emitters of said plurality of first transistors, respectively;

a third transistor having its base connected to the collector of said second transistor;

a fourth transistor having its base connected to the collector of said third transistor; and a current mirror having its input end connected to the collector of said fourth transistor, said current mirror having a plurality of outputs;

said plurality of output portions being respectively connected to the collectors of one of said plurality of first transistors, said second transistor and a load transistor, the base current of said third transistor and said fourth transistor being set to make the sum of the collector currents of said plurality of first transistors and the collector current of said second transistor substantially equal.

* * * * *